United States Patent [19]

Parker et al.

[11] Patent Number: 4,901,114

[45] Date of Patent: Feb. 13, 1990

[54] TRI LEVEL XEROGRAPHY USING A MICR TONER IN COMBINATION WITH A NON-MICR TONER

[75] Inventors: Delmer G. Parker; Michael D. Thompson, both of Rochester; Gerald M. Fletcher, Pittsford, all of N.Y.

[73] Assignee: Xerox Corporation, Stamford, Conn.

[21] Appl. No.: 220,408

[22] Filed: Jun. 28, 1988

Related U.S. Application Data

[63] Continuation of Ser. No. 31,627, Mar. 3, 1987, abandoned.

[51] Int. Cl.[4] ..... G03G 15/00

[52] U.S. Cl. ..... 355/245; 355/328; 101/DIG. 29; 430/31

[58] Field of Search ..... 355/4, 300, 140, 245, 355/251, 328; 283/58; 235/493; 430/31, 42, 45, 106.6; 101/DIG. 13

[56] References Cited

U.S. PATENT DOCUMENTS

| | | | |
|---|---|---|---|
| 3,013,890 | 12/1961 | Bixby | 118/645 |
| 3,045,644 | 7/1962 | Schwertz | 118/645 |
| 3,816,115 | 6/1974 | Gundlach et al. | 430/54 |
| 3,832,170 | 8/1974 | Nagamatsu et al. | 430/46 |
| 3,838,919 | 10/1974 | Takahashi | 355/4 |
| 4,068,938 | 1/1978 | Robertson | 355/4 |
| 4,078,929 | 3/1978 | Gundlach | 430/42 |
| 4,346,982 | 8/1982 | Nakajima et al. | 355/3 R |
| 4,403,848 | 9/1983 | Snelling | 355/4 |
| 4,517,268 | 5/1985 | Gruber et al. | 430/106.6 |
| 4,562,129 | 12/1985 | Tanaka et al. | 430/42 |
| 4,562,130 | 12/1985 | Oka | 430/54 |
| 4,563,081 | 1/1986 | Knapp et al. | 355/300 X |
| 4,618,243 | 10/1986 | Knapp | 355/4 |

OTHER PUBLICATIONS

"Personal Touch" Checks advertisement, 1975, Deluxe Check Printers, Inc. 283/58.

*Primary Examiner*—Arthur T. Grimley
*Assistant Examiner*—J. Pendegrass

[57] ABSTRACT

Disclosed is an electronic printer employing tri-level xerography to superimpose two images with perfect registration during the single pass of a charge retentive member past the processing stations of the printer. One part of the composite image is formed using MICR toner, while the other part of the image is printed with less expensive black, or color toner. For example, the magnetically readable information on a check is printed with MICR toner and the rest of the check in color or in black toner that is not magnetically readable.

6 Claims, 2 Drawing Sheets

TRI LEVEL XEROGRAPHY USING A MICR TONER IN COMBINATION WITH A NON-MICR TONER

This is a continuation of application Ser. No. 07/031,627 filed Mar. 30, 1987, now abandoned.

BACKGROUND OF THE INVENTION

This invention relates generally to printing bank checks or similar documents or object using different types of inks and more particularly to an electrostatic printing apparatus and developer therefor for forming toner images comprising characters suitable for recognition by character recognition devices and ones that are not recognizable by such devices. The different types of toner may be the same color or different colors. Also, they are preferably created using magnetic and non-magnetic toners.

The invention can be utilized in the art of xerography or in the printing arts. In the practice of xerography, it is the general procedure to form an electrostatic latent image on a xerographic surface by first uniformly charging a photoconductive insulating surface, photoreceptor or photoconductor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed.

This method of forming and developing charge patterns, in general is set forth in greater detail in U.S. Pat. No. 2,297,691 to C. F. Carlson. Still other means of forming and developing electrostatic images are set forth in U.S. Pat. No. 2,647,464 to J. P. Ebert; U.S. Pat. No. 2,576,047 to R. M. Schaffert and U.S. Pat. No. 2,825,814 to L. E. Walkup, The use of different type of toner for electrostatically forming the images on a single substrate is disclosed in U.S. Pat. Nos. 4,572,647 issued on Feb. 25, 1986 to Bean et al and 4,509,850 issued on Apr. 9, 1985 to Weigl. The former patent discloses the use of charged insulating marking particles in combination with magnetic polar or polarizable marking particles while the latter discloses the use of polar or polarizable marking particles in combination with charged marking particles.

The use of a single developer composition for creating magnetically recognizable characters has been employed for creating bank checks as disclosed in U.S. Pat. No. 4,517,268 issued on May 14, 1985 to Gruber et al. As disclosed in this patent, the entire clock is printed using such developer.

In U.S. Pat. No. 4,128,202 is disclosed a device for transporting a document that has been mutilated or erroneously encoded wherein there is provided a predetermined area for the receipt of correctly encoded magnetic image character recognition information (MICR).

In contrast to the '202 patent where only a predetermined area of the substrate is encoded or printed with MICR information, the '268 patent discloses the printing of the entire check or substrate using developer materials which are compatible with MICR technology. Such toners have come to be known as MICR toners.

MICR toners are more expensive compared to standard black (i.e. non-magnetic) toners because of the required intrinsic quality of the magnetic ingredients. In addition, the magnetic characters must be positioned and aligned correctly on the check (or document) to enable the magnetic heads to read the characters without error. This places limits on how well the magnetic information bearing parts of the document must be registered with the other printed information. Another problem is that the only way MICR toner can be incorporated into a colored document now is to use a preprinted form or to employ two-pass xerography or as in the '268 patent to print the entire check or document using the more expensive MICR developer. Each of these methods involve penalties; two of them in cost and the other in throughput.

BRIEF SUMMARY OF THE INVENTION

In accordance with the present invention, single-pass tri-level xerography is employed in an electronic printer to superimpose, with perfect registration, two images, one of which is printed with MICR toner, and the other of which is printed with non-magnetic toner or toner in which the magnetic component is reduced such that the toner is considerably less expensive and such that noise which causes reading errors is reduced to a tolerable level. This permits the MICR toner to be used to print only those parts of the image that are necessary for the magnetic ink character recognition system to read the encoded information. A printer using single-pass tri-level with the combination of MICR toner and standard toner enables the following electronic printer options:

Simultaneous merging and printing of a composite image some parts of which are printed with MICR toner and the remainder with non-MICR toner. The non-MICR toner can be colored toner. For example, a check form in color and all the variable information in MICR.

Simultaneous merging and printing, on a pre-printed form, a two-part composite image, some parts of which are printed with MICR toner and the remainder with non-MICR toner. The non-MICR toner can be colored toner. An example would be a pre-printed multi-colored check form with some of the variable information (name, etc.) in non-MICR black toner, and the magnetically encoded check account information printed with MICR toner portions of the image representing variable information are reproduced in a second color.

Because our invention may result in a substrate having different color images thereon, certain references which are known may have some relevancy to our invention. Accordingly, a brief description of such references follows.

One method of producing images in plural (i.e. two colors, black and one highlight color) is disclosed in U.S. Pat. No. 3,013,890 to W. E. Bixby in which a charge pattern of either a positive or negative polarity is developed by a single, two-colored developer. The developer of Bixby comprises a single carrier which supports both triboelectrically relatively positive and relatively negative toner. The positive toner is a first color and the negative toner is of a second color. The method by Bixby develops positively charged image areas with the negative toner and develops negatively charged image areas with the positive toner. A two-color image occurs only when the charge pattern includes both positive and negative polarities.

Plural color development of charge patterns can be created by the Tesi technique. This is disclosed by F. S. Schwertz in U.S. Pat. No. 3,045,644. Like Bixby, Schwertz develops charge patterns which are of both a positive and negative polarity. Schwertz's development system is a set of magnetic brushes, one of which applies relatively positive toner of a first color to the negatively charged areas of the charge pattern and the other of which applies relatively negative toner to the positively charged areas.

Methods and apparatus for making colored xerographic images using colored filters and multiple development and transfer steps are disclosed, respectively, in U.S. Pat. Nos. 3,832,170 to K. Nagamatsu et al and 3,838,919 to T. Takahashi.

U.S. Pat. No. 3,816,115 to R. W. Gundlach and L. F. Bean discloses a method for forming a charge pattern having charged areas of a higher and lower strength of the same polarity. The charge pattern is produced by repetitively charging and imagewise exposing an overcoated xerographic plate to form a composite charge pattern. Development of the charge pattern in one color is disclosed.

A method of two-color development of a charge pattern, preferably with a liquid developer, is disclosed in the commonly assigned U.S. Pat. No. 4,068,938 issued on Jan. 17, 1978. This method requires that the charge pattern for attracting a developer of one color be above a first threshold voltage and that the charge pattern for attracting the developer of the second color be below a second threshold voltage. The second threshold voltage is below the first threshold voltage. Both the first and second charge patterns have a higher voltage than does the background.

As disclosed in U.S. Pat. No. 4,403,848 a multi-color printer uses an additive color process to provide either partial or full color copies. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. Following developing of the last color image, the composite color image is transferred to a copy sheet. In an alternate embodiment, an input section for scanning color originals is provided. The color image signals output by the input section may then be used by the printing section to make full color copies of the original.

In U.S. Pat. No. 4,562,129 there is disclosed an image forming method comprising the steps of forming a latent electrostatic image having at least three different potential levels on a photosensitive member, and developing the latent electrostatic image with a developer to obtain a monochromatic or dichromatic copy image, the developer being composed of at least two components of a nonmagnetic insulating toner and a high-resistivity magnetic carrier triboelectrically chargeable with the toner and having a high resistivity of at least $10^{-12}$ ohm-cm, the carrier being in the form of particles about 5 to about 40 microns in size, prepared by dispersing a magnetic fine powder in an insulating resin and containing the magnetic fine powder in proportion of 50 to 75% by weight.

U.S. Pat. No. 4,562,130 relates to a composite image forming method having the following features: (A) Forming a composite latent electrostatic image of potentials at three different levels by two image exposures, the potential of the background area (nonimage area) resulting from the first image exposure is corrected to a stable intermediate potential which is constant at all times by charging the area with scorotron charging means. Accordingly the image can be developed to a satisfactory copy image free from fog. (B) The composite latent electrostatic image is developed by a single developing device collectively, or by two developing devices. In the latter case, the composite latent image is not developed after it has been formed, but the latent image resulting from the first exposure is developed first before the second exposure, and the latent image resulting from the second exposure is thereafter developed, whereby the fog due to an edging effect is prevented whereby there is produced a satisfactory copy image.

In U.S. Pat. No. 4,346,982, there is disclosed an electrophotographic recording device having means for uniformly charging the surface of a light-sensitive recording medium, means for forming latent images on said light-sensitive recording medium and means for developing said latent image into visual images, said electrophotographic recordng device being characterized in that said means for forming latent images on said light-sensitive recording medium comprises a plurality of exposing means for exposing a positive optical image and a negative optical image in such a manner that the light receiving region of said negative optical image overlaps the light receiving region of said positive optical image, whereby a latent image is formed on the surface of said light-sensitive recording medium consisting of a first area which does not receive any light of said negative or positive image and holds an original potential, a second area which receives the light of only said positive image and hold a reduced potential from that of said original potential and a third area which receives the light of both of said negative image and said positive image and holds a further reduced potential than said reduced potential of said second area.

In U.S. Pat. No. 4,078,929, R. Gundlach teaches the use of tri-level xerography as a means to achieve single-pass highlight color copy. In this scheme the photoreceptor, initially charged to voltage $V_0$, is discharged to approximately $V_0/2$ imagewise in the background (white) image areas, and to near zero or residual potential in the highlight color (color other than black) portions of the image. The unexposed portions of the photoreceptor now correspond to the parts of the image that are to be printed black. It should be noted that whether the charged area is developed black or color in practice depends on the choice of developer polarity as described below.

The charge pattern in the '929 patent is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

DETAILED DESCRIPTION OF THE PREFERRED EMBODIMENTS OF THE INVENTION

Figure 1A:
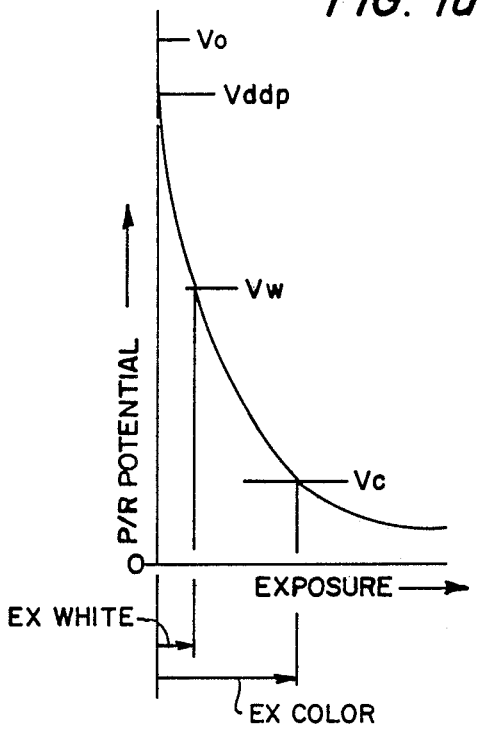
FIG. 1A is a plot of photoreceptor potential versus exposure for a tri-level image.

FIG. 1A illustrates details of the tri-level electrostatic latent image which can be utilized in Highlight color imaging. Here $V_0$ is the initial charge level, $V_{ddp}$ the dark discharge potential (unexposed), $V_w$ the white discharge level and $V_c$ the photoconductor residual potential (full exposure).

Figure 1B:
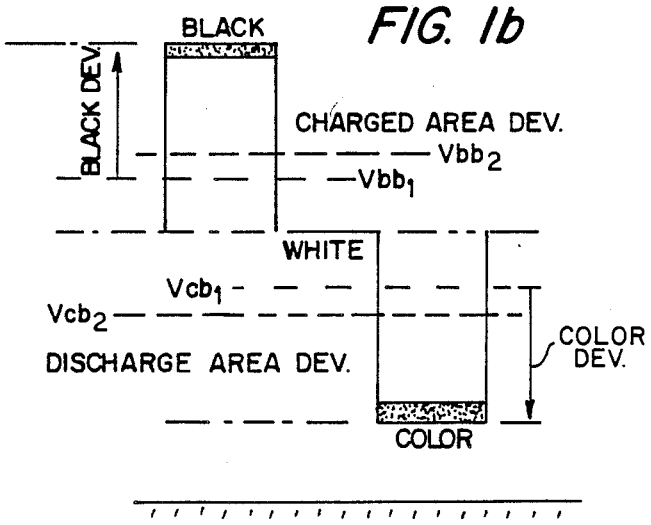
FIG. 1B is a plot of photoreceptor potential illustrating single-pass, highlight color latent image characteristics.

Color discrimination in the development of the electrostatic latent image is achieved by passing the photoreceptor through two developer housings in tandem which housings are electrically biased to voltages which are offset from the background voltage $V_w$, the direction of offset depending on the toner in the housing. One housing (for the sake of illustration, the first) contain developer with black toner having triboelectric properties such that the toner is driven to the most highly charged ($V_{ddp}$) areas of the latent image by the electric field between the photoreceptor and the development rolls biased at $V_{bb}$ (V black bias) as shown in FIG. 1B. Conversely, the triboelectric charge on the colored toner in the second housing is chosen so that the toner is urged towards parts of the latent image at residual potential by the electric field existing between the photoreceptor and the development rolls in the second housing at bias voltage $V_{cb}$ (V color bias).

Because the composite image developed on the photoreceptor consists of both positive and negative toner, a pre-transfer corona charging step is necessary to condition the toner to enable effective transfer to a substrate using corona discharge.

Figure 2:
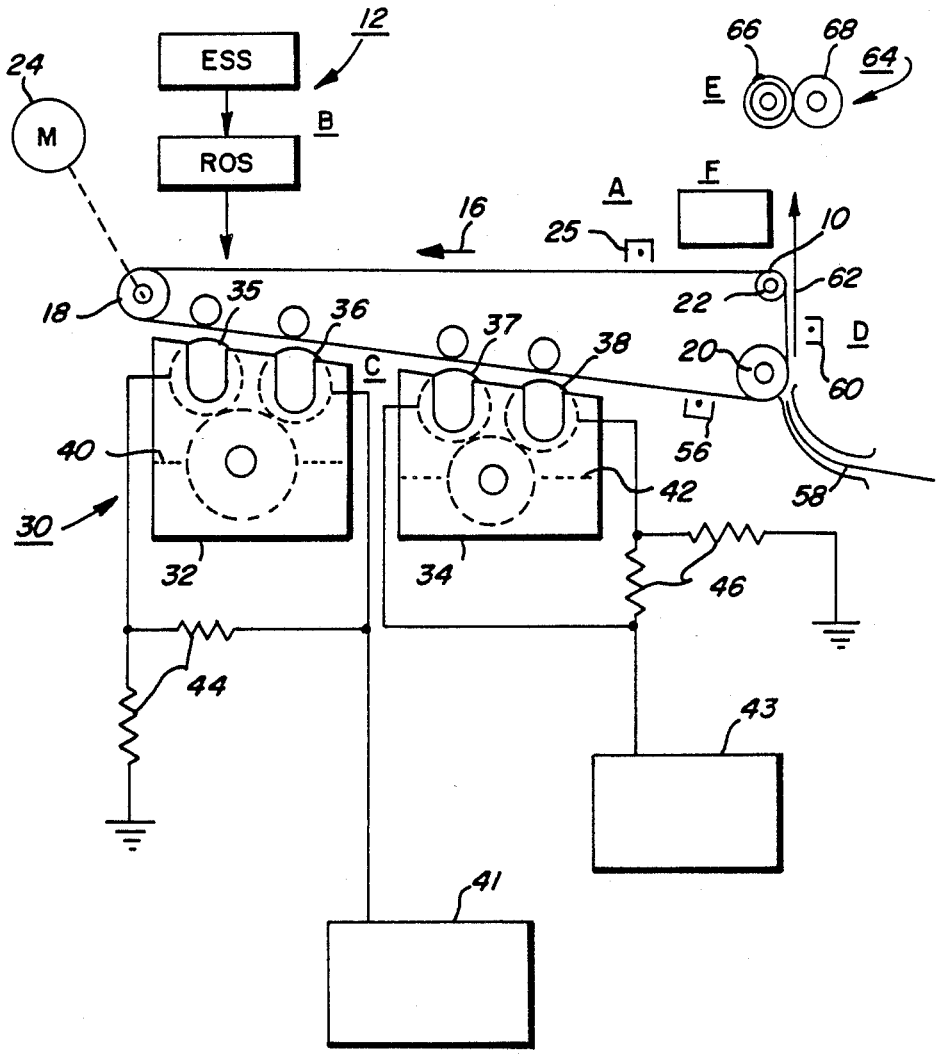
FIG. 2 is schematic illustration of a printing apparatus incorporating the inventive features of our invention.

FIG. 2 schematically depicts the various components of an illustrative electrophotographic printing machine incorporating the present invention.

As shown in FIG. 2, the printing machine utilizes a photoconductive belt 10 which consists of a photoconductive surface and an electrically conductive substrate. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 24 rotates roller 18 to advance belt 10 in the direction of arrow 16. Roller 18 is coupled to motor 24 by suitable means such as a belt drive.

As can be seen by further reference to FIG. 2, initially a portion of belt 10 passes through charging station A. At charging station A, a corona discharge device such as a scorotron or corotron indicated generally by the reference numeral 25, charges the belt 10 to a selectively high uniform positive or negative potential, $V_0$. Preferably charging is negative.

Next, the charged portion of the photoreceptor surface is advanced through exposure station B. At exposure station B, The uniformly charged photoreceptor or charge retentive surface 10 is exposed to a laser based input and/or output scanning device 12 which causes the charge retentive surface to be discharged in accordance with the output from the scanning device. Preferably the scanning device is a three level raster output scanning device.

The photoreceptor which is initially charged to a voltage $V_0$, undergoes dark decay to a level $V_{ddp}$. When exposed at the exposure station B it is discharged to $V_w$ imagewise in the background (white) image areas and to $V_c$ which is near zero or ground potential in the highlight (i.e. color other than black) color parts of the image. See FIG. 1A.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Each developer roller pair forms brush structure comprising toner particles which are attracted by the latent images on the photoreceptor.

Color discrimination in the development of the electrostatic latent imagee is achieved by passing the photoreceptor past the two developer housings in a single pass with the magnetic brush rolls electrically biased to voltages which are offset from the background voltage $V_w$, the direction of offset depending on the toner in the housing. One housing e.g. 32 (for the sake of illustration, the first) contains developer with black toner 40 having triboelectric properties such that the toner is driven to the most highly charged ($V_{ddp}$) areas of the latent image by the electrostatic field (development field) between the photoreceptor and the development rolls biased at $V_{bb1}$ and $V_{bb2}$ (V black biases) as shown in FIG. 1B. Conversely, the triboelectric charge on colored toner 42 in the second housing is chosen so that the toner is urged towards parts of the latent image at residual potential, $V_c$ by the electrostatic field (development field) existing between the photoreceptor and the development rolls in the second housing at bias voltages $V_{cb1}$ and $V_{cb2}$ (V color biases).

In prior art tri-level xerography, the entire photoreceptor voltage difference ($|V_{ddp}-V_c|$, as shown in FIG. 1A) is shared equally between the charged area development (CAD) and the discharged area development (DAD). This corresponds to $\approx$600 volts (if a realistic photoreceptor value for $V_{ddp}$ of 700 volts and a residual discharge voltage of 100 volts are assumed). Allowing an additional 100 volts for the cleaning field in each development housing ($|V_{bb}-V_{white}|$ or $|V_{white-Vcb}|$) means an actual development contrast voltage for CAD of $\approx$200 volts and an $\approx$equal amount for DAD. In the foregoing case the 200 volts of contrast voltage is provided by electrically biasing the first developer housing to a voltage level of approximately 500 volts and the second developer housing to a voltage level of 300 volts. Although 200 volts contrast is generally sufficient, 250 volts is more desirable in practice to assure adequate system latitude as the developers age.

Accordingly, a more desirable development field is provided with the first developer housing by biasing the roller 35 to a voltage level ($V_{bb1}$) equal to 450 volts which provides 250 ($|V_{ddp}-V_{bb1}|$) or (700–450=250) volts for the development field. An added advantage of this increased development field is that the reverse development field is reduced by the magnitude of such increase, therefore, there is less tendency for induction charging to reverse the polarity of the charge on the black toner and cause it to be attracted to the red latent image. The reverse development field is that field which is established between the developer rollers and the colored image areas. The bias on the roller 36 in the first housing is 500 volts, consequently, the increased development seen with the roller 35 is not present with the roller 36. However, the cleaning fluid ($|V_{bb2}-V_w|$) is twice that of the field established between roller 35 and the photoreceptor in the $V_w$ areas. The bias, $V_{cb1}$ on the roller 36 is 350 volts thereby providing 250 volts for the development field between the roller 37 and the colored image areas of the photoreceptor. The bias, $V_{cb2}$ on the roller 38 is 300 volts thereby providing only a 200 volt development field but a larger cleaning as in the case of the roller 36.

The foregoing developer biases are provided by power supplies 41 and 43. These power supplies are each provided with suitable resistor pairs 44 and 46 for providing the different biases to the rolls 35, 36, 37 and 38.

In the embodiment of the invention disclosed in FIG. 2, the housing 32 contains black MICR type developer such as disclosed in the '268 patent. The housing 34 preferably contain magnetic developer whose magnetic component is reduced such that it is not readably by MICR devices. Alternatively, the developer in the housing 34 may be non-magnetic.

While the developers employed in the preferred embodiment are different colors it should be appreciated that they could also be the same color.

A sheet of support material 58 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a pre-transfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a back-up roller 68. Sheet 58 passes between fuser roller 66 and back-up roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F.

Subsequent to cleaning, a discharge lamp (not shown) floods the photoconductive surface with light to dissipate any residual electrostatic charge remaining prior to the charging thereof for the successive imaging cycle.

While the invention is disclosed in connection with xerographic methods of forming the images before transfer to the final substrate it will be appreciated that other methods may be employed without departing from the spirit of the invention. For example, the image comprising two different types of toner could be formed by direct electrostatic printing on a substrate or by means of ionographic printing methods.

In direct electrostatic imaging, toner is presented to the final substrate in image configuration while in ionography ions are applied to the final substrate in image configuration. The ionographically formed images are then rendered visible by the application of suitable toner.

What is claimed is:

1. An improved process for electrostatically generating printed documents in a single pass which comprises:

providing a substrate;

using electrostatic printing method and magnetic toner, printing only character image, recognizable by magnetic character recognition devices, on said substrate for subsequent recognition by a magnetic character recognition device; and using electrostatic printing methods and non-magnetic toner, printing character images on said substrate which are not recognizable by magnetic character recognition devices.

2. The process according to claim 1 wherein said electrostatic method comprise the formation of latent images on a charge retentive surface with subsequent rendering of said images visible with the application of toner thereto.

3. The process according to claim 2 wherein the rendering of said image visible comprises moving said charge retentive surface past at least two developer housing in a single pass of said charge retentive surface.

4. The process according to claim 3 wherein one of said toners is black and the other is another color.

5. The process according to claim 4 wherein said latent images are formed electronically.

6. An improved process for electrostatically generating printed documents in a single pass which comprises:

providing a substrate;

using electrostatic printing methods and black, magnetic toner, printing character images on said substrate for subsequent recognition by a magnetic character recognition device;

using electrostatic printing methods and black, non-magnetic toner, printing character images on said substrate which are not recognizable by magnetic character recognition devices; and said images being formed on a charge retentive surface with subsequent rendering of said images visible with the application of toner by moving said charge retentive surface past at least two developer housings in a single pass of said charge retentive surface.

* * * * *